US005171059A

United States Patent [19]

Patrick

[11] Patent Number: 5,171,059

[45] Date of Patent: Dec. 15, 1992

[54] LOUNGE CHAIR ENCLOSURE

[76] Inventor: William D. Patrick, 109 Sterling St., Negaunee, Mich. 49866

[21] Appl. No.: 791,081

[22] Filed: Nov. 12, 1991

[51] Int. Cl.[5] ..... A47C 7/66

[52] U.S. Cl. ..... 297/184; 52/143; 135/901

[58] Field of Search ..... 297/184; 52/79.1, 143; 135/900, 901

[56] References Cited

U.S. PATENT DOCUMENTS

| | | | |
|---|---|---|---|
| 377,512 | 2/1888 | Bunn | 297/184 |
| 3,768,860 | 10/1973 | Barker | 297/184 |
| 3,799,608 | 3/1974 | Smutny et al. | 297/184 |
| 4,470,631 | 9/1984 | Powell | 297/184 X |

FOREIGN PATENT DOCUMENTS

| | | | |
|---|---|---|---|
| 937661 | 12/1955 | Fed. Rep. of Germany | 297/184 |
| 2307558 | 8/1974 | Fed. Rep. of Germany | 297/184 |
| 133397 | 1/1979 | Fed. Rep. of Germany | 297/184 |

*Primary Examiner*—Peter R. Brown

*Attorney, Agent, or Firm*—Andrus, Sceales, Starke & Sawall

[57] ABSTRACT

An enclosure for use with an outdoor lounge chair includes a rigid base that defines a liquid containing cavity and integral front, back and side walls which, along with a top, define a rigid enclosure having a top opening through which a lounge chair may be placed.

8 Claims, 3 Drawing Sheets 10
28
38
38
30
26
14
24
18
22

10
28
38
30
14
12
16
18
20
32
34
36
40
22

10
30
34
24
20
18
26
14
22
32
36
40

FIG. 4
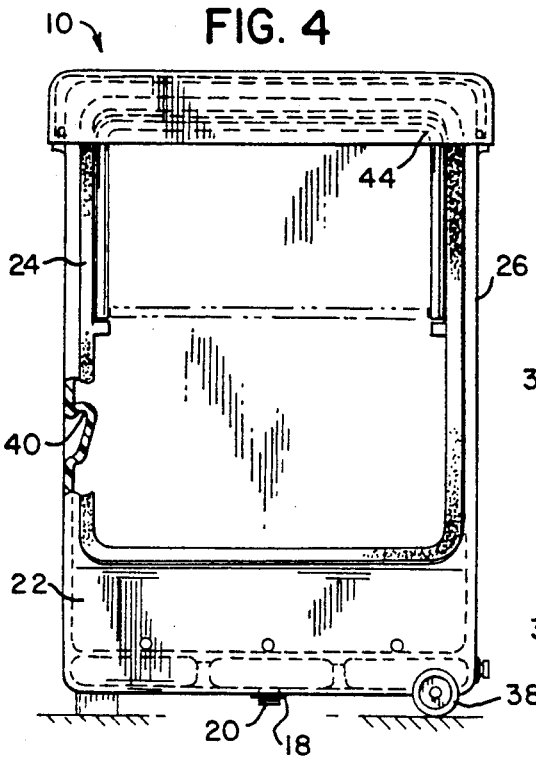
FIG. 5
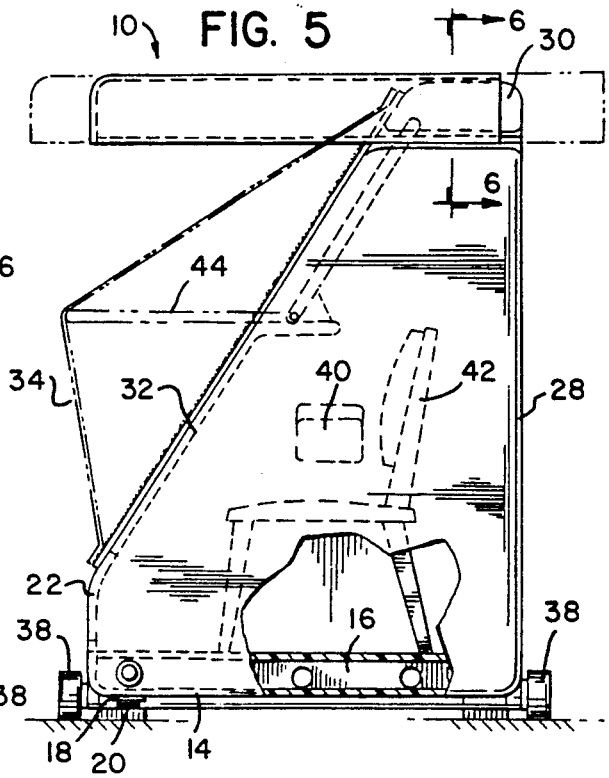
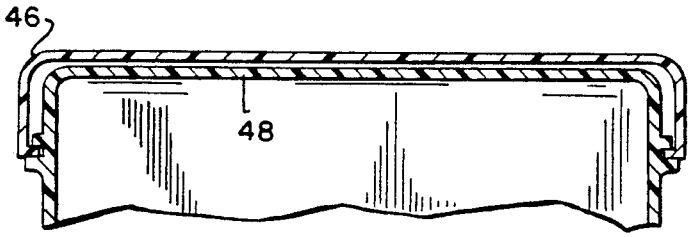
FIG. 6
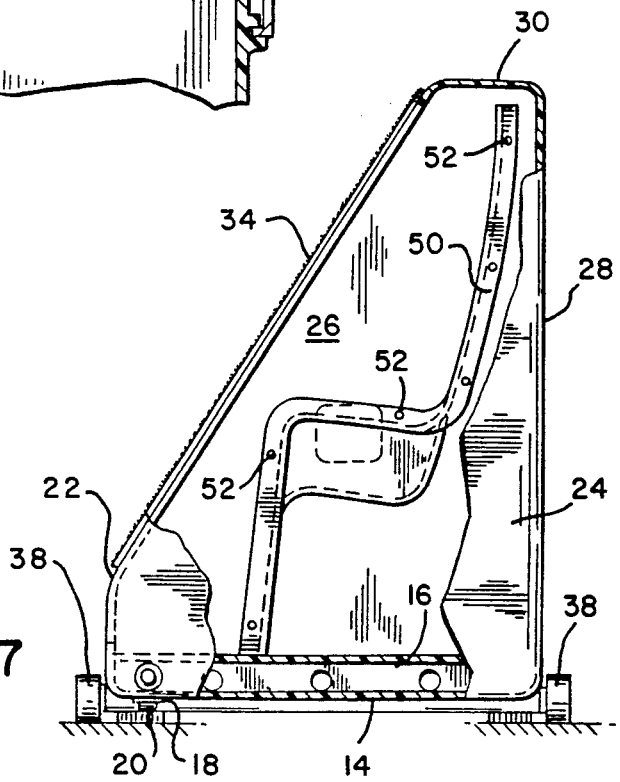
FIG. 7

FIG. 8
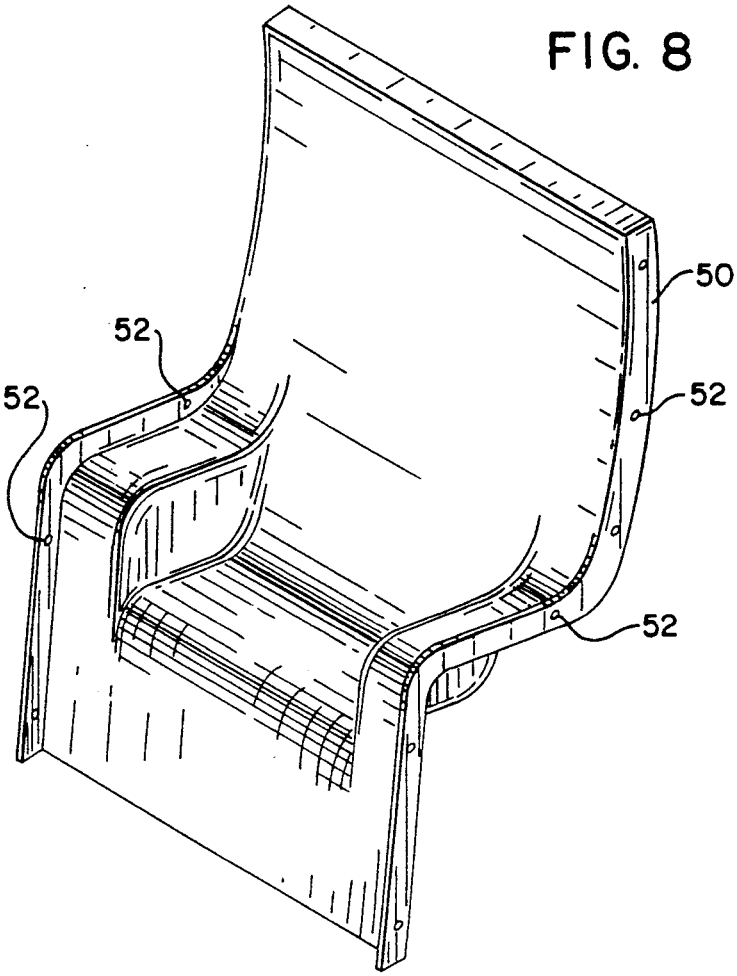
FIG. 10
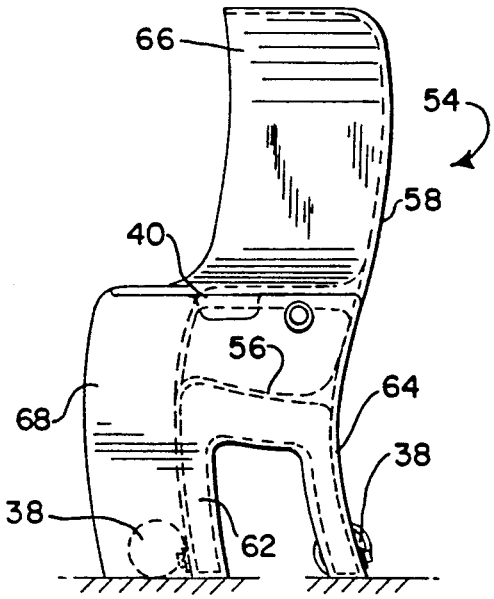
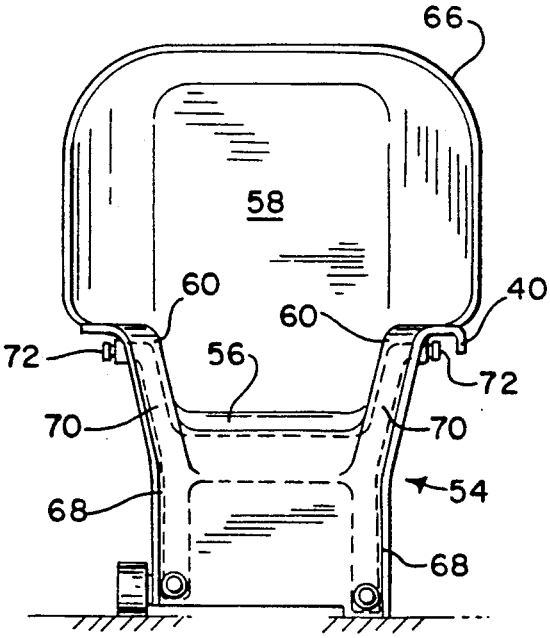
FIG. 9

LOUNGE CHAIR ENCLOSURE

BACKGROUND OF THE INVENTION

The present invention relates to sheltered recreational and lounge seating and more particularly to a chair or lounge enclosure that provides a wind barrier for the user so that the sunbathing season may be extended into seasons not normally compatible with outdoor sunbathing.

In the northern latitudes of the United States, the sunbathing season is rather abbreviated due to the early onset of fall weather and the late arrival of spring. A sunny day can provide enough warmth even in the off season, but the relative warmth of the sun is usually more than offset by the chilling wind. However, if one can obtain shelter from the chilling wind, the warmth of the sun can be sufficient to allow sunbathing.

In the past, flexible tent-like structures have been utilized as wind barriers. However, these structures typically require some assembly and usually do not provide a satisfactory wind barrier. Also, the flimsiness of the structures makes them very susceptible to damage or movement by the wind.

It is an object of the present invention to provide a stable and rigid enclosure for a lounge chair so that a sunbather may be completely sheltered by the wind and yet have access to the sun's warming rays.

SUMMARY OF THE INVENTION

An enclosure for use with an outdoor lounge chair includes a base that defines a liquid holding cavity having a sealable port so that liquid may be introduced into the base to provide weight and stability to the enclosure.

In accordance with one aspect of the invention, the enclosure is provided with a vertical front panel that is connected to and extends upwardly from the base.

In accordance with yet another aspect of the invention, a pair of rigid side panels are connected to opposite sides and extend upwardly from the base. The side panels are also connected to the front panel.

In accordance with still another aspect of the invention, a rigid back panel is connected to and extends upwardly from the base. The back panel is also connected to the side panels.

In accordance with still another aspect of the invention, a rigid top is connected to and extends from the back panel to the front panel. The top is also connected to the side panels.

The various panels and the top define an enclosure having a top opening through which an outdoor lounge chair may be placed.

In accordance with yet another aspect of the invention, the enclosure is provided with a screen that covers the opening.

In accordance with yet another aspect of the invention, the enclosure is provided with a handle and a pair of wheels so that the enclosure may be easily moved from one location to another.

The present invention thus provides a stable and rigid enclosure for a lounge chair. The enclosure is manufactured from a rigid material so as to provide a complete barrier to the wind while allowing an opening for access to the sun's rays.

BRIEF DESCRIPTION OF THE DRAWINGS

The drawings illustrate the best mode presently contemplated of carrying out the invention.

In the drawings:

FIG. 4 is a front view with portions broken away of an alternate embodiment of the enclosure of FIG. 1;

FIG. 5 is a side view with portions broken away of the enclosure shown in FIG. 4;

FIG. 6 is a sectional view along the line 6—6 of FIG. 5;

FIG. 7 is a side view with parts broken away of an alternate embodiment of the invention;

FIG. 8 is a perspective view of the molded chair utilized in the embodiment of FIG. 7;

FIG. 9 is a front view of an alternate embodiment of the invention; and

FIG. 10 is a side view of the alternate embodiment shown in FIG. 9.

DETAILED DESCRIPTION OF THE INVENTION

Figures 1, 2, 3:
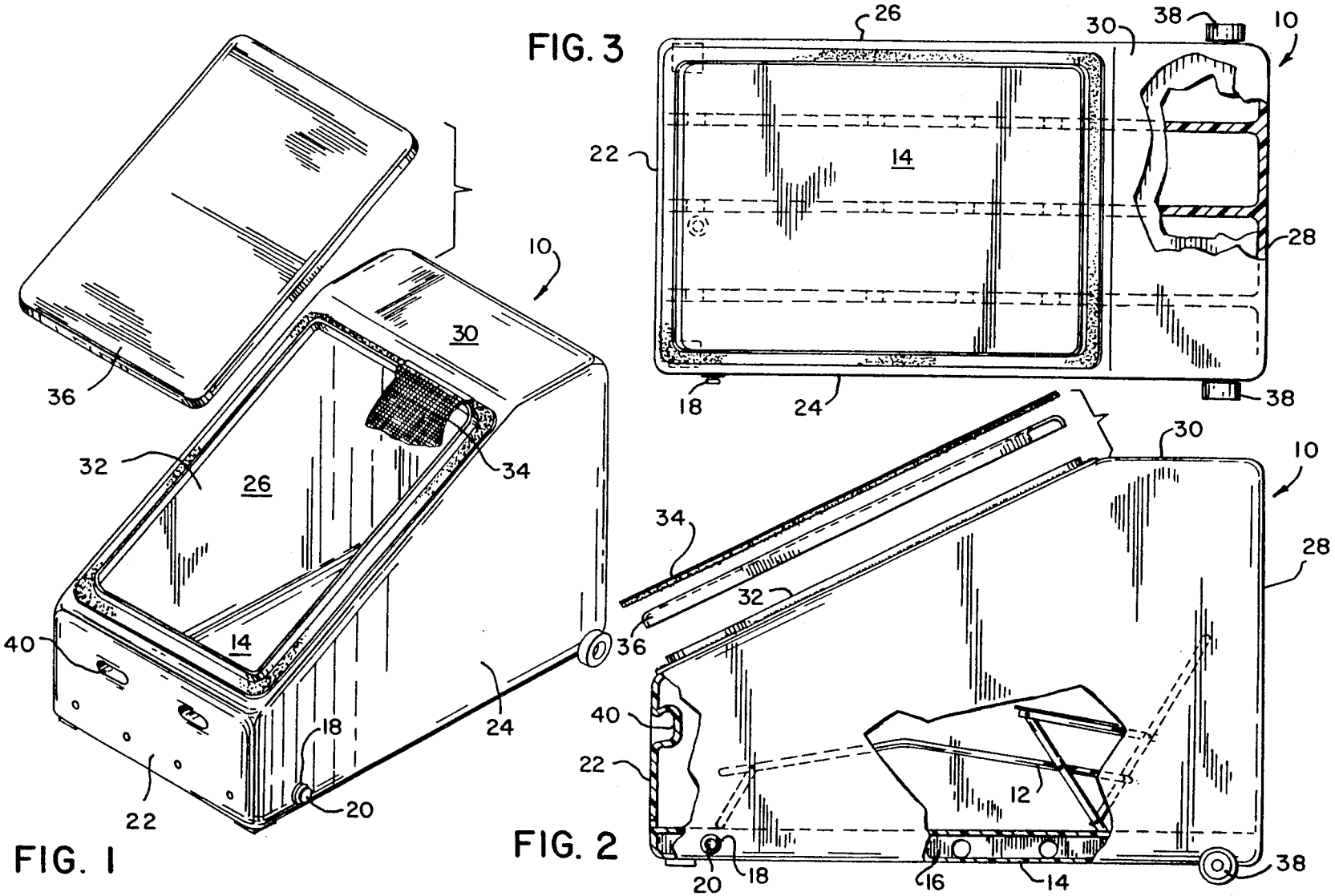
FIG. 1 is a perspective view of an enclosure for a lounge chair constructed according to the present invention.
FIG. 2 is a side view with portions broken away of the enclosure shown in FIG. 1.
FIG. 3 is a top view with portions broken away of the enclosure shown in FIG. 1.

As shown in FIGS. 1–3, an enclosure 10 for a lounge chair 12 includes a base 14 which defines a liquid holding cavity 16. A port 18 in the side wall of base 14 is sealed with a cap 20. Port 18 allows cavity 16 to be filled with water or some other liquid to provide weight and stability to enclosure 10.

A vertical front panel 22 is connected to and extends upwardly from base 14.

A pair of side panels 24 and 26 are connected to opposite sides of base 14 and extend upwardly from the base. Side panels 24 and 26 are also connected to front panel 22.

A rigid vertical back panel 28 is connected to and extends upwardly from base 14. Back panel 28 is also connected to side panels 24 and 26.

A rigid horizontal top 30 is connected to side panels 24 and 26 and back panel 28 and extends forwardly towards front panel 22.

Base 14, front panel 22, side panels 24 and 26, back panel 28 and top 30 define a rigid enclosure 10 having a top opening 32 through which lounge chair 14 may be placed.

Enclosure 10 is also provided with a screen panel 34 which may be attached by velcro or other fastening means across opening 32. Screen panel 34 may be used to prevent insects from entering enclosure 10. Enclosure 10 is also provided with a cover 36 that may be placed across opening 32 when enclosure 10 is not in use.

Enclosure 10 is also provided with a pair of wheels 38 disposed on base 14 at one end of enclosure 10. At the opposite end of enclosure 10, front panel 22 is provided with a pair of cavities 40 which serve as handles so that enclosure 10 may be lifted at the front end and rolled into position on wheels 38.

In the embodiment shown in FIGS. 1–3, enclosure 10 is formed of molded plastic material so that the various panels are integral with each other. Front panel 22 has a vertical dimension less than that of back panel 28 so that side walls 24 and 26 slope upwardly from front panel 22 to top 30 and opening 32 is angularly disposed.

FIGS. 4–6 illustrate an alternate embodiment of the invention for use with a straight back chair 42 rather than lounge chair 12. This embodiment is also provided with a base 14 that defines a liquid containing cavity 16 having an access port 18 sealed by cap 20.

Similarly, enclosure 10 is provided with a front panel 22, a back panel 28, a pair of side panels 24 and 26 and a top 30, all of which are integral with each other and which define an opening 32 through which chair 42 may be placed.

In this embodiment, enclosure 10 is also provided with a detachable screen panel 34. In this alternate embodiment, an extender bar 44 is pivotally attached to side walls 26 and 28 and is movable between a retracted position (shown in phantom) and an extended position as shown in FIG. 5 in which screen 34 is bowed outwardly so that it is not immediately adjacent the face of the user seated in chair 42.

The embodiment shown in FIGS. 4–6 also includes an integral handle 40 and wheels 38 to facilitate the movement of enclosure 10.

In the alternate embodiment, top 30 is a two piece assembly in which a first top piece 46 is slidably engaged with a second stationary top piece 48. This allows top piece 46 to be moved relative to top piece 48 to vary the distance that the top extends towards front panel 22.

FIG. 7 illustrates an alternate embodiment of the invention in which a chair 50 is formed from the same material as enclosure 10 and is fixedly attached to side wall 24 and 26 by means of fasteners inserted through holes 52. FIGS. 9 and 10 illustrate another alternate embodiment of the invention in which a one piece molded chair 54 having a seat 56, a back 58 integral with and extending upwardly from seat 56, a pair of arm rests 60 and forward legs 62 and rearward legs 64 which elevate and support seat 56.

Back 58 of chair 54 is provided with a shell 66 that extends forwardly from the top and sides of seat back 58 to provide a wind barrier for the upper body of the user of chair 54. A pair of wings are integral with and extend forwardly from forward legs 62 and arm rests 60 to provide a wind barrier for the legs of the user of chair 54.

As with the previous embodiments, chair 54 is provided with wheels 38 and handle 40 to facilitate its movement.

Chair 54 is also provided with cavities 70 which may be filled with liquid through sealable port 72 to provide weight and stability for chair 54.

Various modes of carrying out the invention are contemplated as being within the scope of the following claims particularly pointing out and distinctly claiming the subject matter regarded as the invention.

I claim:

1. An enclosure for use with an outdoor lounge chair comprising:

a rigid base serving as a floor for the lounge chair, a rigid vertical front panel connected to and extending upwardly from said base, a pair of rigid side panels connected to opposite sides and extending upwardly from said base, said side panels also being connected to said front panel, a rigid back panel connected to and extending upwardly from said base, said back panel also being connected to said side panels, a rigid horizontal top connected to an extending toward said front panel from said back panel and also being connected to said side panels, said base, front panel, side panels, back panel and top defining an enclosure having a top opening through which an outdoor lounge chair may be placed, and said front panel having a vertical dimension less than that of said back panel so that a portion of said side walls slope upwardly from said front panel to said top and said opening is angularly disposed, said base defining a liquid holding cavity with said cavity having a sealable port so that liquid may be introduced into and retained in said cavity to provide weight and stability to the enclosure.

2. The enclosure defined in claim 1 further comprising at least two wheels disposed on substantially opposite sides of said base at one end of the enclosure to allow rolling movement of the enclosure and handle means disposed on the enclosure at an end opposite that of said wheel bearing end so that said handle end of the enclosure may be lifted and the enclosure may be pushed or pulled into position on said wheels.

3. The enclosure defined in claim 1 further comprising a screen removably disposed within said top opening.

4. The enclosure defined in claim 1 further comprising a protective cover removably disposed within said top opening.

5. The enclosure defined in claim 1 wherein said top comprises a first top piece slidably engaged with a second top piece so that said first top piece may be moved relative to said second top piece to vary the distance said top extends toward said front panel.

6. The enclosure defined in claim 1 wherein the enclosure is formed from molded plastic and further comprising a chair made of substantially the same material and fixedly attached to the inside of the enclosure.

7. An improved chair for outdoor use of the type having a seat, a back extending upwardly from the seat, a pair of arm rests, and forward and rearward legs to elevate and support the seat, said improvement comprising an upper shell integral with and extending forwardly from the top and sides of the seat back to provide a wind barrier for the upper body of the chair user and a pair of vertical wings integral with and extending forwardly from the forward legs and arm rests to provide a wind barrier for the legs of the chair user, said arm rests and said legs defining a liquid holding cavity with said cavity having a sealable port so that liquid may be introduced into and retained in said cavity to provide weight and stability to the chair.

8. The chair defined in claim 7 further comprising at least two wheels disposed on substantially opposite sides of the chair to allow rolling movement of the chair and handle means disposed on the chair so that the chair may be tilted and pushed or pulled into position on said wheels.

* * * * *

UNITED STATES PATENT AND TRADEMARK OFFICE

CERTIFICATE OF CORRECTION

PATENT NO. : 5,171,059

DATED : December 15, 1992

INVENTOR(S) : William D. Patrick

It is certified that error appears in the above-identified patent and that said Letters Patent is hereby corrected as shown below:

IN THE CLAIMS:

Col. 4, L7: Delete "an" and subtitute therefor —and—.

Signed and Sealed this

Twenty-sixth Day of October, 1993

Bruce Lehman

*Attest:*

BRUCE LEHMAN

*Attesting Officer*

*Commissioner of Patents and Trademarks*